US005449983A

United States Patent [19]

Sugawara et al.

[11] Patent Number: 5,449,983

[45] Date of Patent: Sep. 12, 1995

[54] COLOR CATHODE RAY TUBE APPARATUS

[75] Inventors: Shigeru Sugawara, Saitama; Junichi Kimiya; Eiji Kamohara, both of Fukaya, all of Japan

[73] Assignee: Kabushiki Kaisha Toshiba, Kawasaki, Japan

[21] Appl. No.: 230,376

[22] Filed: Apr. 20, 1994

[30] Foreign Application Priority Data

Apr. 20, 1993 [JP] Japan ..... 5-091718
Dec. 17, 1993 [JP] Japan ..... 5-317644

[51] Int. Cl.[6] ..... G09G 1/04; H01J 29/46

[52] U.S. Cl. ..... 315/382; 315/15; 313/414

[58] Field of Search ..... 315/382, 382.1, 14–15; 313/414

[56] References Cited

U.S. PATENT DOCUMENTS

| | | | |
|---|---|---|---|
| 2,957,106 | 10/1960 | Moodey . | |
| 3,359,448 | 12/1967 | Bashara et al. . | |
| 3,772,554 | 11/1973 | Hughes . | |
| 4,771,216 | 9/1988 | Blacker et al. | 315/382 |
| 4,897,575 | 1/1990 | Shimoma et al. | 315/15 |
| 4,935,663 | 6/1990 | Shimomla et al. | 313/412 |

FOREIGN PATENT DOCUMENTS

| | | |
|---|---|---|
| 0354750 | 2/1990 | European Pat. Off. . |
| 0406886 | 1/1991 | European Pat. Off. . |
| 0444670 | 9/1991 | European Pat. Off. . |
| 0535953 | 4/1993 | European Pat. Off. . |
| 61-99249 | 5/1986 | Japan . |
| 61-250934 | 11/1986 | Japan . |
| 272546 | 3/1990 | Japan . |
| 603005 | 8/1978 | Switzerland . |

OTHER PUBLICATIONS

Patent Abstracts of Japan, vol. 017, No. 230 (E-1361), May 11, 1993 & JP-A-04 359831 (Matsushita Electric Ind Co Ltd) Dec. 14, 1992.

Patent Abstracts of Japan, vol. 017, No. 393 (E-1402), Jul. 22, 1993 & JP-A-05 074327 (Matsushita Electric Ind Co Ltd) Mar. 26, 1993.

*Primary Examiner*—Gregory C. Issing
*Attorney, Agent, or Firm*—Cushman Darby & Cushman

[57] ABSTRACT

In a color cathode ray tube apparatus including an electron gun assembly having a main electron lens section constituted by a plurality of electrodes for focusing three electron beams arranged in a line on a target and a deflection unit for deflecting the three electron beams, at least an electrode to which a voltage obtained by superposing a variable voltage changed in accordance with a deflection amount of the electron beams on a predetermined DC voltage and an electrode which substantially opposes the electrode and to which a voltage obtained by superposing a variable voltage induced through a capacitance between the opposing electrodes on a predetermined voltage applied through a resistor arranged in a tube is applied are arranged in a main electron lens section, and the main electron lens section is made into an electron lens for changing the focusing state of the electron beams in synchronism with deflection of the electron beams. Therefore, a high-performance cathode ray tube which can preferably correct distortion of a beam spot caused by a deflection error in the entire area of a screen and has a high resolution can be obtained.

4 Claims, 5 Drawing Sheets

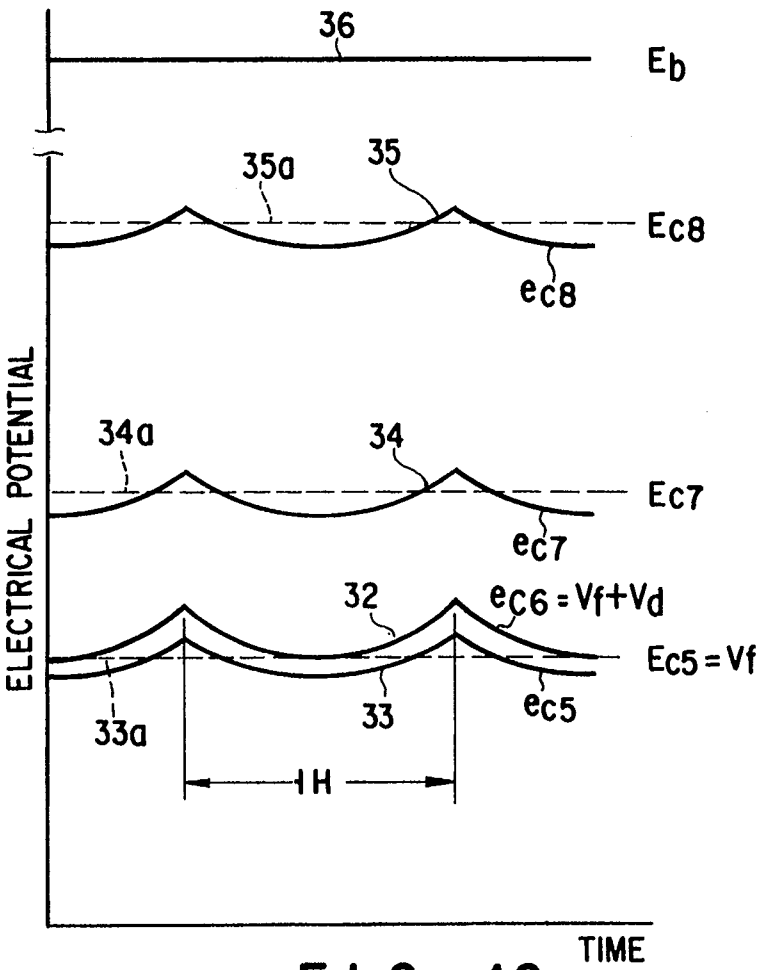
FIG. 10
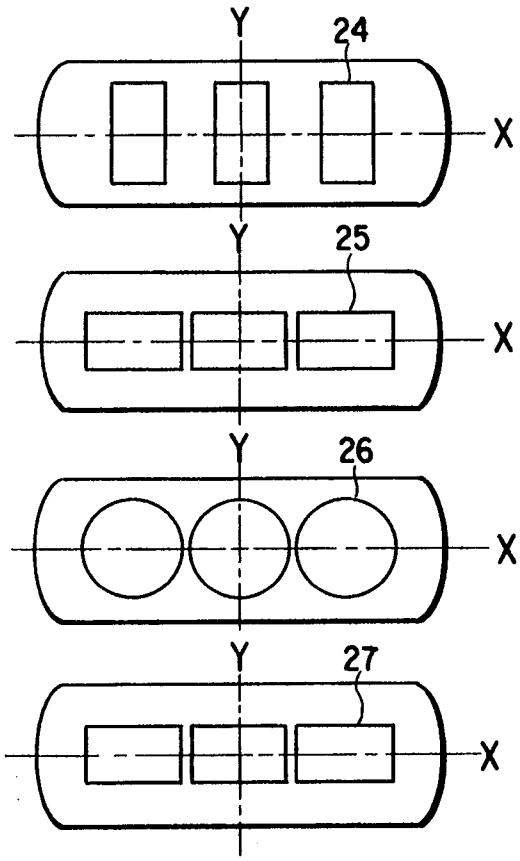
FIG. 8A
FIG. 8B
FIG. 8C
FIG. 8D
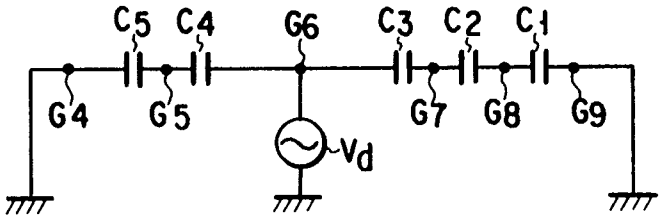
FIG. 9

COLOR CATHODE RAY TUBE APPARATUS

BACKGROUND OF THE INVENTION

1. Field of the Invention

The present invention relates to a color cathode ray tube apparatus such as a color picture tube and, more particularly, to a color cathode ray tube apparatus using a dynamic focus scheme for correcting a deflection error caused by a magnetic field generated by a deflection yoke.

2. Description of the Related Art

In general, a color picture tube apparatus, as shown in FIG. 1, has an envelope constituted by a panel 1 and a funnel 2 integrally connected to the panel 1, and a phosphor screen 3 constituted by stripe-like or dot-like tricolor phosphor layers for emitting blue, green, and red beams is formed on the inner surface of the panel 1. A shadow mask 4 in which a large number of apertures are formed is arranged opposite to the phosphor screen inside the phosphor screen 3. On the other hand, an electron gun assembly 7 for emitting three electron beams 6B, 6G, and 6R is arranged in a neck 5 of the funnel 2. The three electron beams 6B, 6G, and 6R emitted from the electron gun assembly 7 are deflected by horizontal and vertical magnetic fields generated by a deflection unit 8 arranged outside the funnel 2, and the phosphor screen 3 is horizontally and vertically scanned through the shadow mask 4, thereby displaying a color image on the phosphor screen.

As the above color picture tube apparatus, an in-line type color picture tube apparatus in which an electron gun assembly for emitting three electron beams 6B, 6G, and 6R arranged in a line, constituted by the center beam 6G and the pair of side beams 6B and 6R, and passing through the same horizontal plane is used as the electron gun assembly 7 is known.

The electron gun assembly 7 generally comprises an electron beam generating section constituted by a cathode and a plurality of electrodes sequentially arranged adjacent to each other on the cathode, for controlling electron emission from the cathode and focusing the emitted electrons to form three electron beams 6B, 6G, and 6R and a main electron lens section constituted by a plurality of electrodes for focusing and converging the three electron beams 6B, 6G, and 6R obtained from the electron beam generating section on the phosphor screen 3.

In the above color picture tube apparatus, in order to obtain excellent image characteristics on the phosphor screen 3, the three electron beams 6B, 6G, and 6R emitted from the electron gun assembly 7 must be appropriately focused, and electron beams 6B, 6G, and 6R must be converged on the entire area of the phosphor screen 3.

Of the above required conditions, convergence of the electron beams 6B, 6G, and 6R, as described in U.S. Pat. No. 2,957,106, can be achieved by a method in which the three electron beams to be emitted from the electron gun assembly are inclined prior to the emission and then emitted. As described in U.S. Pat. No. 3,772,554, the following method is known. That is, of three electron beam through holes of each of the electrodes constituting the main electron lens section, a pair of side beam through holes are slightly shifted outside with respect to the side beam through holes of an adjacent electrode on the electron beam generating section side to converge the three electron beams. Both the methods are popularly, practically used.

However, even when the electron gun assembly 7 employing the above methods is incorporated in the cathode ray tube, in the actual color picture tube apparatus, when the electron beams are deflected, misconvergence of the three electron beams occurs. For this reason, a color picture tube apparatus having the following arrangement is known. That is, the deflection unit 8 generates a pin-cushion-shaped horizontal deflection magnetic field and a barrel-shaped vertical deflection magnetic field with respect to the three electron beams arranged in a line and passing through the same horizontal plane, and the three electron beams 6B, 6G, and 6R arranged in a line are converted on the entire area of the phosphor screen 3 by the deflection magnetic fields. This color picture tube apparatus is called a self-convergence in-line type color picture tube apparatus, and is dominant in color picture tube apparatuses at present.

However, when the three electron beams 6B, 6G, and 6R are converted by the deflection magnetic fields from the deflection unit 8 as described above, the electron beams 6B, 6G, and 6R considerably receive deflection errors, and distortion of the beam spot on the phosphor screen 3 increases, thereby causing a decrease in resolution. That is, as shown in FIG. 2 with respect to a horizontal deflection magnetic field, when an electron beam 6 is deflected to the right side of the drawing, the electron beam 6 receives a focusing effect by a pin-cushion-shaped horizontal deflection magnetic field 10 in a vertical direction (Y-axis) as indicated by an arrow 11. On the other hand, in a horizontal direction (X-axis), the magnetic flux densities on the right and left sides of the electron beam 6 are different from each other, and the magnetic flux density on the right side is higher than that on the left side. For this reason, the right side of the electron beam 6 receives a large deflection effect, and the electron beam 6 is horizontally drawn.

More specifically, the pin-cushion-shaped horizontal deflection magnetic field 10 works as a quadrupole lens for horizontally diverging and vertically focusing the electron beam 6, and has a prism effect for deflecting the electron beam 6. As a result, as shown in FIG. 3, a beam spot 13, at a peripheral portion of the screen, of the electron beam 6 deflected by the horizontal deflection magnetic field 10 is set in an over-focus state in the vertical direction, and low-luminance halo portions 15 are formed at the upper and lower portions of a high-luminance portion 14. Moreover, the beam spot 13 is set in an under-focus state in the horizontal direction and horizontally extends, and the resolution at the peripheral portion of the screen considerably decreases.

In order to prevent a decrease in resolution caused by a deflection error, in Jpn. Pat. Appln. KOKAI Publication Nos. 61-99249, 61-250934, or 2-72546, as shown in FIG. 4, electron gun assemblies having the following arrangement are disclosed. That is, first to fifth grids G1 to G5 are sequentially arranged along the traveling direction (the direction of the phosphor screen) of the electron beam 6, a predetermined DC voltage Vf is applied to the third grid G3, a voltage obtained by superposing a variable voltage Vd changed in accordance with the deflection amount of the electron beam 6 on the DC voltage Vf is applied to the fourth grid G4, and an anode voltage Eb is applied to the fifth grid G5.

In this electron gun assembly, when the above voltages Vf and Vd are applied, a quadrupole lens is formed between the third and fourth grids G3 and G4, and an end focusing lens is formed between the fourth and fifth grids G4 and G5. In the electron gun assemblies of the above publications, only the electrode structures are different from each other. The electron lenses which are basically equal to each other and have the same effects are formed in the electron gun assemblies, respectively.

FIG. 5 shows the above lenses using an optical model. In this optical model, an electron beam 6 emitted from the cathode passes through a quadrupole lens QL formed between the third and fourth grids G3 and G4, an end focusing lens EL formed between the fourth and fifth grids G4 and GS, an electron lens qL, and a prism pL of the deflection unit to reach the phosphor screen 3. When the electron beam 6 is directed to the center of the phosphor screen 3 without being deflected, the third and fourth grids G3 and G4 have almost equal potentials, and the quadrupole lens QL is not formed between the third and fourth grids. Therefore, the electron beam 6 is appropriately focused on the center of the phosphor screen 3 by the end focusing lens EL, and the beam spot 13 on the phosphor screen 3 has a circular shape.

In contrast to this, when the electron beam 6 is deflected, the potential of the fourth grid G4 increases in accordance with the deflection amount of the electron beam 6, the quadrupole lens QL is formed between the third and fourth grids G3 and G4, and, at the same time, the horizontal and vertical focusing effects of the end focusing lens EL between the fourth and fifth grids G4 and G5 are reduced. For this reason, as indicated by a broken line in FIG. 5, the electron beam 6 emitted from the electron gun assembly is set in an under-focus state in the vertical direction. However, since the electron beam 6 receives a focusing effect by a deflection error, i.e., an astigmatism, the electron beam 6 is appropriately focused in the vertical direction. On the other hand, the focusing effect of the quadrupole lens rarely changes in the horizontal direction, and the electron beam 6 is set in an under-focus state by the deflection magnetic field. However, since the distance between the peripheral portion of the phosphor screen 3 and the electron gun assembly is longer than that between the central portion and the electron gun assembly, the electron beam 6 is appropriately focused in the horizontal direction, and the beam spot 13 on the phosphor screen 3 has an almost circular shape.

However, when the electron beam 6 is focused by this dynamic focus scheme, the following problems are posed.

That is, a deflection error increases in accordance with an increase in size of the tube or an increase in deflection angle, and the vertical diverging effect of the quadrupole lens QL required for correcting this deflection error must be increased. As a result, since the horizontal focusing effect of the quadrupole lens QL increases, the focusing effect of the end focusing lens EL must be considerably reduced. For this reason, a potential difference between the electrodes required for reducing the focusing effect of the end focusing lens EL increases, and problems on safety or reliability, e.g., an increase in circuit load of a television set, discharge, or breakdown voltage are posed. As a more serious problem, the beam spot at the peripheral portion of the phosphor screen horizontally elongated shape. In this manner, when the horizontal size of the beam spot is larger than the vertical size, the horizontal resolution of the screen considerably decreases. In addition, when the vertical size of the beam spot becomes very small, a moiré is formed due to the interference between the vertical size and the arrangement pitch of the apertures of the shadow mask, thereby degrading image quality.

A reason why the beam spot has a horizontally elongated shape will be is described as follows. That is, as shown in FIG. 5, the electron beam 6 emitted from the cathode forms a crossover, is slightly pre-focused by a pre-focus lens formed by the second and third grids, is incident on an electron lens system at a divergent angle $\alpha$, and is focused at a focusing angle $\beta$Hc in the horizontal direction and at a focusing angle $\beta$Vc in the vertical direction on the center of the phosphor screen 3. At this time, assuming that the potential of a crossover portion and the potential of the phosphor screen are represented by Vo and Vi, respectively, a horizontal image formation magnification MHc and a vertical image formation magnification MVc are represented by equations (1) and (2), respectively:

$$MHc=(\alpha/\beta Hc)(Vo/Vi)^{\frac{1}{2}} \quad (1)$$

$$MVc=(\alpha/\beta Vc)(Vo/Vi)^{\frac{1}{2}} \quad (2)$$

When the beam is to be focused on the center of the phosphor screen 3, the following equation is established:

$$\beta Hc=\beta Vc \quad (3)$$

For this reason, the image formation magnifications MHc and MVc satisfy the following equation:

$$MHc=MVc \quad (4)$$

and the beam spot at the center of the phosphor screen 3 has a circular shape.

However, when the electron beam is deflected, the quadrupole lens qL of the deflection unit works, and the quadrupole lens QL for correcting the deflection error works. At this time, at the peripheral portion of the phosphor screen 3, when the electron beam is focused at a focusing angle $\beta$Hp in the horizontal direction and at a focusing angle $\beta$Vp in the vertical direction, a horizontal image formation magnification MHp and a vertical image formation magnification MVp are represented by equations (5) and (6):

$$MHp=(\alpha/\beta Hp)(Vo/Vi)^{\frac{1}{2}} \quad (5)$$

$$MVp=(\alpha/\beta Vp)(Vo/Vi)^{\frac{1}{2}} \quad (6)$$

When the electron beam is to be focused on the peripheral portion of the phosphor screen 3, the following condition is satisfied:

$$\beta Hp<\beta Vp \quad (7)$$

and the image formation magnifications MHp and MVp satisfy inequality (8). For this reason, at the peripheral portion of the phosphor screen 3, the beam spot has a horizontally elongated shape.

$$MHp>MVp \quad (8)$$

In order to decrease the horizontal size of the beam spot at the peripheral portion of the phosphor screen 3, the following electron gun assembly is disclosed in Jpn.

Pat. Appln. KOKAI Publication Nos. 3-95835 and 3-93135. That is, in addition to the quadrupole and end focusing lenses of the electron gun assembly, an additional quadrupole lens is formed between the cathode and the above quadrupole lens, and the additional quadrupole lens is caused to have effects reverse to the focusing and diverging effects of the quadrupole lens of the electron gun assembly, thereby horizontally diverging and vertically focusing the electron beam. In this manner, the horizontal focusing angle $\beta$Hp of the electron beam is made close to the focusing angle $\beta$Vp in the vertical direction, and the image formation magnifications MHp and MVp are defined by equation (9);

$$MHp \approx MVp \quad (9)$$

However, with the above technical means, as described in Television Society Technical Report IDY92-17, a divergent angle a of the electron beam in flowing a large current increases. For this reason, when the electron beam is further horizontally diverged by the additional quadrupole lens, the electron beam is largely influenced by a spherical aberration in the horizontal direction of the end focusing lens, and the size of the beam spot on the phosphor screen 3 does not theoretically decrease in the horizontal direction.

As described above, when a pin-cushion-shaped or barrel-shaped horizontal deflection magnetic field is generated by the deflection unit with respect to the three electron beams emitted from the electron gun assembly, passing on the same horizontal plane, and arranged in a line, the electron beams are influenced by the deflection error of the deflection magnetic field, and the beam spot on the peripheral portion of the phosphor screen is distorted, and the resolution considerably decreases.

As a technical means for solving the decrease in resolution caused by the deflection error, an electron gun assembly which uses a dynamic focus scheme and in which a quadrupole lens and an end focusing lens are formed along the traveling direction of an electron beam is conventionally known. However, in this electron gun assembly, the vertical diverging effect of the quadrupole lens for correcting the deflection error must be increased with an increase in size of the tube or an increase in deflection angle. In accordance with this, the horiziontal focusing effect of the quadrupole lens also increases, and the focusing effect of the end focusing lens must be considerably decreased. For this reason, the potential difference between the electrodes for forming the end focusing lens increases, and problems on safety or reliability, e.g., an increase in circuit load of a television set, discharge, or breakdown voltage are posed. Moreover, in the electron gun assembly, the beam spot at the peripheral portion of the phosphor screen has a horizontally elongated shape, the horizontal resolution of the screen decreases, and a moiré is formed due to the interference between the vertical size and the arrangement pitch of the apertures of the shadow mask, thereby degrading image quality.

In order to solve the above problems, an electron gun assembly in which, in addition to the above quadrupole lens and the end focusing lens, another quadrupole lens is additionally formed between the cathode and the above quadrupole lens is known. However, when the quadrupole lens is additionally formed, the horizontal size of the beam spot on the phosphor screen does not theoretically decrease.

SUMMARY OF THE INVENTION

It is an object of the present invention to provide a color cathode ray tube apparatus which has a high resolution and high reliability and in which an electron gun assembly using a dynamic focus scheme corrects a deflection error caused by a magnetic field generated by a deflection unit to make the beam spot of each electron beam have an almost circular shape.

According to the present invention, there is provided a color cathode ray tube apparatus comprising an electron gun assembly having a main electron lens section constituted by a plurality of electrodes for focusing three electron beams which are arranged in a line and obtained from an electron beam generating section on a target and a deflection unit for deflecting the three electron beams emitted from the electron gun assembly in horizontal and vertical directions, the main electron lens section is constituted by at least a first electron lens and a second electron lens formed between the first electron lens and a phosphor screen, and the first electron lens is constituted by a first electrode to which a voltage changed in synchronism with at least the horizontal deflection amount of the electron beams in the deflection unit is applied from the outside of the tube and at least one second electrode to which a voltage is applied through an electric resistor. The variable voltage is divided by a capacitance between the first electrode and the second electrode, and the divided voltages are superposed on the voltage of the second electrode. When the electron beams are directed to the center of the phorphor screen, the voltages of the first and second electrodes are almost equal to each other. When the electron beams are deflected to the peripheral portion of the phosphor screen, a difference between the voltages of the first and second electrodes occurs.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

FIG. 8A is a plan view showing the shapes of electron beam through holes formed in the surface of the fifth grid of the electron gun assembly shown in FIG. 7, which surface opposes the sixth grid;

FIG. 8B is a plan view showing the shapes of the electron beam through holes of the sixth grid shown in FIG. 7;

FIG. 8C is a view showing the shapes of the electron beam through holes of the seventh and eighth girds shown in FIG. 7;

FIG. 8D is a plan view showing the shapes of the electron beam through holes formed in the surface of the ninth grid, which surface opposes the eighth grid;

FIG. 9 is an equivalent circuit diagram for explaining a variable voltage induced through a capacitance between electrodes of the fifth to ninth grids when an electron beam is horizontally deflected in the electron gun assembly shown in FIG. 7;

FIG. 10 is a graph showing changes in potentials of the fifth to ninth grids, which potentials are obtained by inducing the variable voltage in the circuit shown in FIG. 9;

DETAILED DESCRIPTION OF THE PREFERRED EMBODIMENTS

Embodiments of the present invention will be described below with reference to the accompanying drawings.

Figure 1:
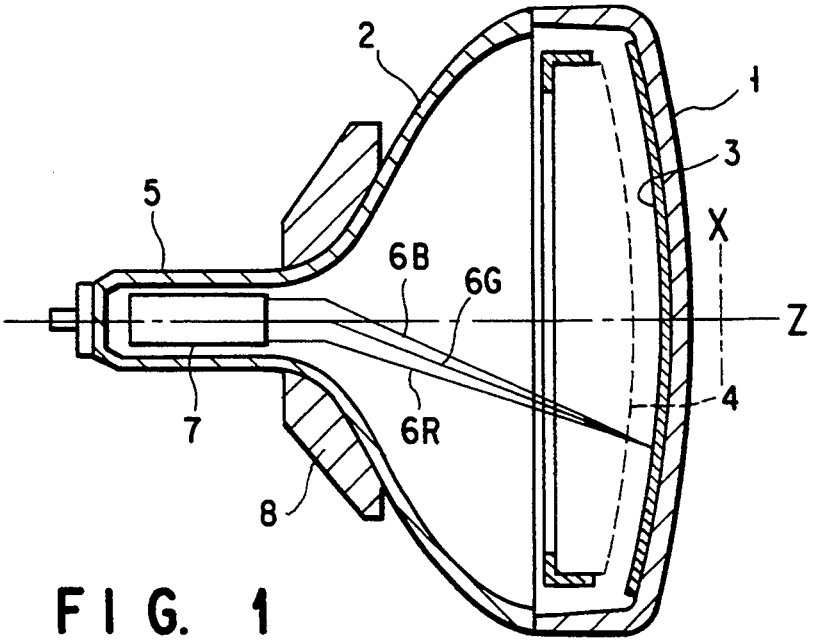
FIG. 1 is a schematic sectional view showing the structure of a conventional color picture tube apparatus.
Figure 2:
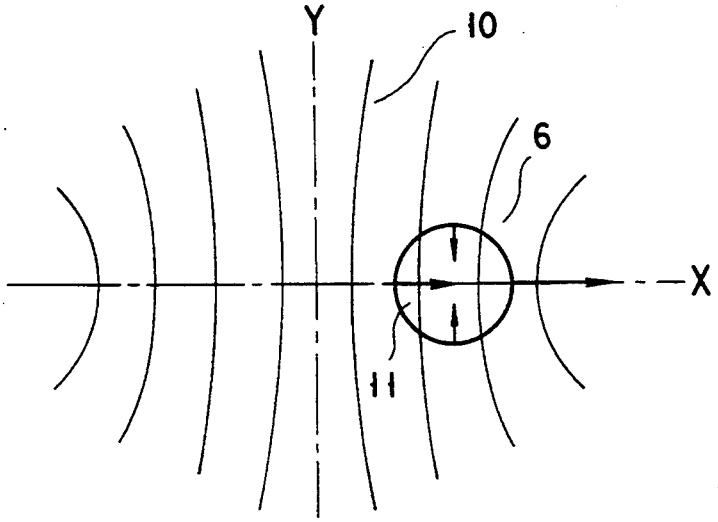
FIG. 2 is a view for explaining an effect of a pin-cushion-shaped horizontal deflection magnetic field with respect to an electron beam in the conventional color picture tube apparatus.
Figure 3:
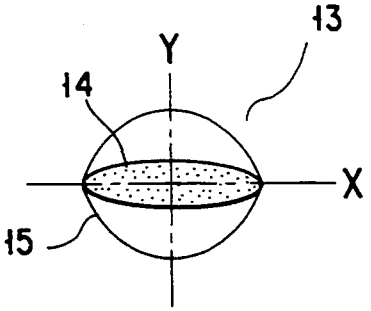
FIG. 3 is a view showing the shape of a beam spot of an electron beam, deflected by the pin-cushion-shaped horizontal deflection magnetic field shown in FIG. 2, at a screen peripheral portion.
Figure 4:
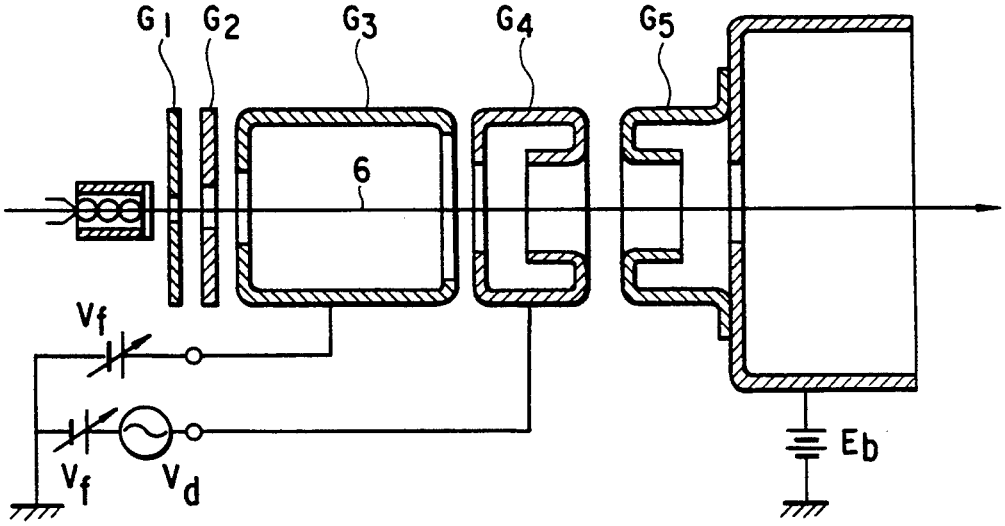
FIG. 4 is a schematic sectional view showing the structure of a conventional electron gun assembly having an electrode arrangement for preventing a decrease in resolution caused by a deflection error.
Figure 5:
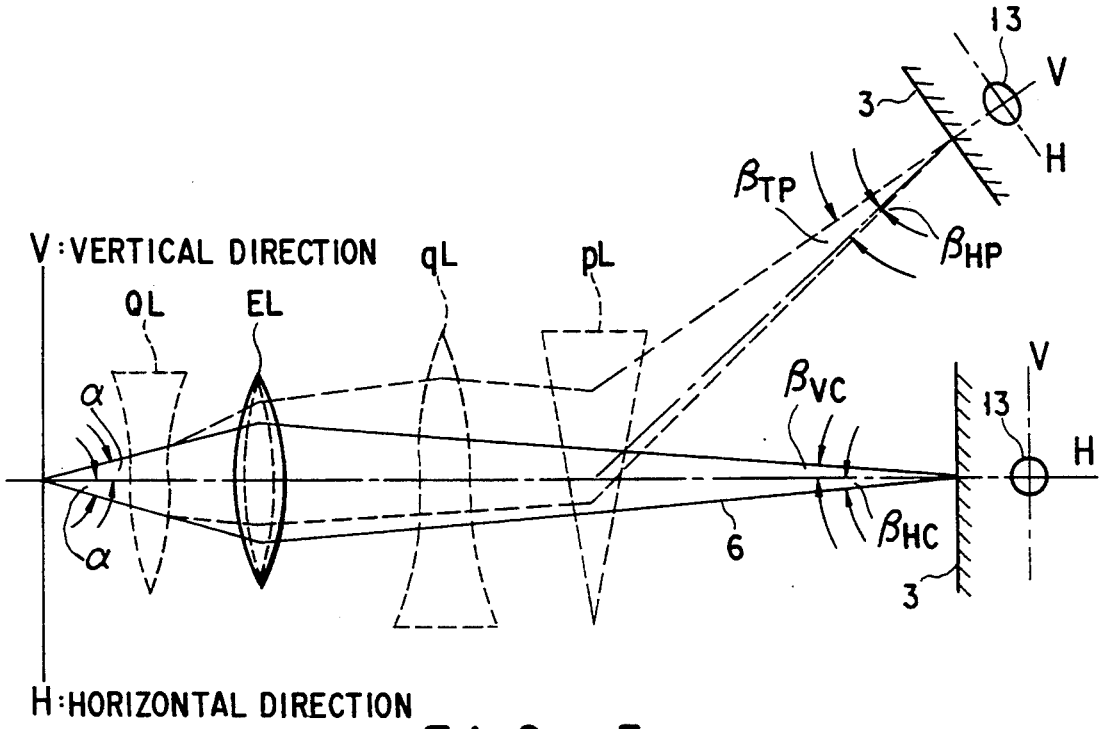
FIG. 5 is a view for explaining electron lenses formed between electrodes of the electron gun assembly shown in FIG. 4.
Figure 6:
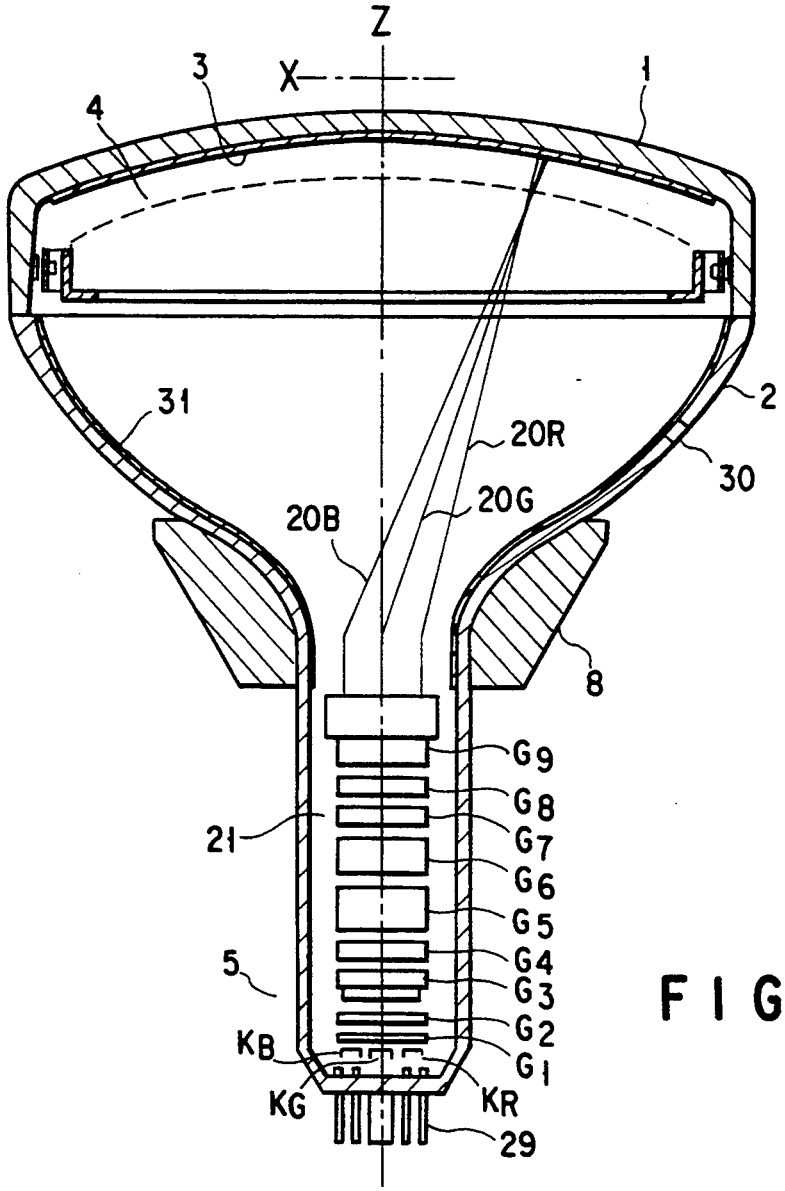
FIG. 6 is a schematic sectional view showing the structure of a color picture tube apparatus according to an embodiment of the present invention.

FIG. 6 shows a color picture tube apparatus according to an embodiment of the present invention. This color picture tube apparatus has an envelope constituted by a panel 1 and a funnel 2 integrally connected to the panel 1. A phosphor screen, i.e., a target 3, constituted by stripe-like tricolor phosphor layers for emitting blue, green, and red beams is formed on the inner surface of the panel 1. A shadow mask 4 in which a large number of apertures are formed is arranged opposite to the phosphor screen 3 inside the panel 1. On the other hand, an electron gun assembly 21 for emitting three electron beams 20B, 20G, and 20R arranged in a line and passing on the same horizontal plane is arranged in a neck 5 of the funnel 2. Moreover, a resistor (not shown) is arranged along the electron gun assembly 21 on its one side. A deflection unit 8 is arranged outside the funnel 2. The three electron beams 20B, 20G, and 20R emitted from the electron gun assembly 21 are deflected by horizontal and vertical deflection magnetic fields generated by the deflection unit 8 to horizontally and vertically scan the phosphor screen 3 through the shadow mask 4, thereby displaying a color image.

Figure 7:
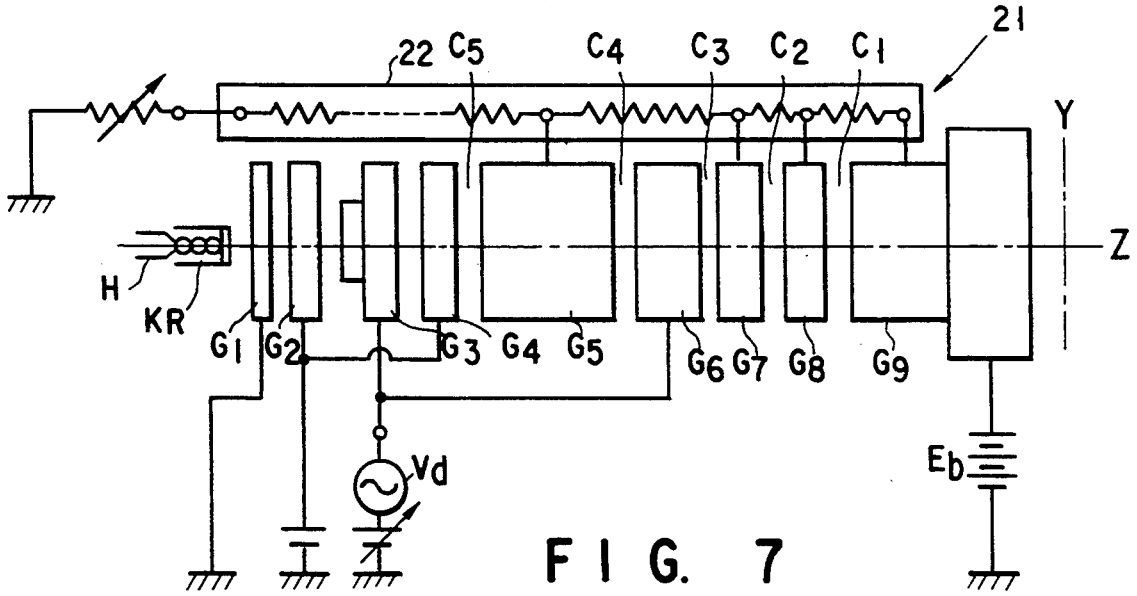
FIG. 7 is a schematic view showing the structure of the electron gun assembly shown in FIG. 6.

The electron gun assembly 21, as shown in FIG. 7, is constituted by three cathodes KB, KG, and KR (only KR is shown in FIG. 7) horizontally arranged in a line, a heater H for independently heating the cathodes KB, KG, and KR, and first to ninth grids Gk1 to Gk9 sequentially arranged with predetermined intervals from the cathodes KB, KG, and KR to the phosphor screen. Note that, in FIG. 7, reference numeral 22 denotes a resistor arranged on one side of the electron gun assembly and extending along the electron gun assembly.

The first and second grids G1 and G2 are constituted by plate electrodes, the third, fourth, fifth, and sixth grids G3, G4, G5, and G6 are constituted by cylindrical electrodes, the seventh and eighth grids G7 and G8 are constituted by thick plate electrodes, and the ninth grid G9 is constituted by a cup-like electrode. In the surfaces of the first, second, third, and fourth grids G1, G2, G3, G4 and the surface, of fifth grid G5, opposite to the fourth grid G4, three electrode beam through holes are formed in a line with respect to the three cathodes KB, KG, and KR. In the surface, of the fifth grid G5, opposite to the sixth grid G6, as shown in FIG. 8A, three almost rectangular electron beam through holes 24 each having a long side along the vertical direction (Y-axis) are formed in a line with respect to the three cathodes KB, KG, and KR. In the sixth grid G6, as shown in FIG. 8B, three almost rectangular electron beam through holes 25 each having a long side along the horizontal direction (X-axis) are formed in a line with respect to the three cathodes KB, KG, and KR. In the seventh and eighth grids G7 and G8, as shown in FIG. 8C, three almost circular electron beam through holes 26 are formed in a line with respect to the three cathodes KB, KG, and KR. In the surface, of the ninth grid G9, opposite to the eighth grid G8, as shown in FIG. 8D, three almost rectangular electron beam through holes 27 each having a long side along the horizontal direction are formed in a line with respect to the three cathodes KB, KG, and KR.

In the electron gun assembly, a voltage obtained by superposing a video signal voltage on a voltage of 100 to 200 V is applied to the cathodes KB, KG, and KR through stem pins 29 shown in FIG. 6, and a ground voltage is applied to the first grid G1. The second and fourth grids G2 and G4 are connected each other and the third and sixth grid G3 and G6 are connected each other, in the tube. A voltage of 500 to 1,000 V is applied to the second and fourth grids G2 and G4 through the stem pins 29, and a voltage obtained by superposing a variable voltage Vd changed in synchronism with a deflection current passing through the deflection unit on a focusing voltage Vf which is 20 to 30% of an anode voltage Eb is applied to the third and sixth grids G3 and G6 through the stem pins 29. Divided voltages obtained by dividing the anode voltage Eb by the resistor 22 are applied to the fifth, seventh, eighth grids G5, G7, and G8. More specifically, a voltage which is equal to or slightly higher than the focusing voltage Vf applied to the third and sixth grids G3 and G6 is applied to the fifth grid G5, a voltage which is 35 to 45% of the anode voltage Eb is applied to the seventh grid G7, and a voltage which is 50 to 70% of the anode voltage Eb is applied to the eighth grid G8. In addition, the anode voltage Eb is applied to the ninth grid G9 through an anode terminal 30 shown in FIG. 6 and a conductive film formed on the inner surface of the funnel.

In the electron gun assembly, the variable voltage Vd applied to the third and sixth grids G5 and G6 is induced between the electrodes through capacitors which are present between the electrodes. More specifically, in this electron gun assembly, capacitances are present between the electrodes of the fourth to ninth grids G4 to G9, the anode voltage Eb is divided by the resistor 22 and the divided voltages are applied to the fifth, seventh and eighth grids G5, G7 and G8. Thus the variable voltage Vd applied to the third and sixth grids G3 and G6 is induced and applied to the fifth, seventh and eighth grids G5, G7 and G8 through the capacitances. In this case, when the AC impedance of each of the capacitances between the electrodes is considerably smaller than an AC impedance of the electric resistance 22, the AC impedance R can be neglected.

In order to obtain a variable voltage induced by each of the electrodes of the fourth to ninth grids G4 to B9, the capacitance between the fourth and fifth grids G4 and G5 is represented by C5; the capacitance between the fifth and sixth grids G5 and G6, C4; the capacitance between the sixth and seventh grids G6 and G7, C3; the capacitance between the seventh an eighth grids G7 and G8, C2; and the capacitance between the eighth and ninth grids G8 and G9, C1. In this case, when a DC voltage is short-circuited, and the resistance of the resistor is omitted, an equivalent circuit (FIG. 9) with respect to an AC voltage is obtained. In this case, when all the capacitances C1 to C5 between the electrodes are equal to each other, $\frac{1}{2}$ of the variable voltage Vd applied to the sixth grid G6 is induced by the fifth grid G5, $\frac{2}{3}$ of the variable voltage Vd is induced by the seventh grid G7, and $\frac{1}{3}$ of the variable voltage Vd is induced by the eighth grid G8.

In FIG. 10, the potentials of the electrodes by which these variable voltages are induced are plotted along the ordinate, and the abscissa is used as a time axis. A curve 32 indicates a voltage (Vf+Vd) obtained by superposing the variable voltage Vd on the focusing voltage Vf applied to the sixth grid, a curve 33 indicates a voltage ec5 of the fifth grid, a curve 34 indicates a voltage ec7 of the seventh grid, a curve 35 indicates a voltage ec8 of the eighth grid, and a straight line 36 indicates the anode voltage Eb applied to the ninth grid G9. Note that broken lines 33*a*, 34*a*, and 35*a* indicate voltages Ec5, Ec7, and Ec8 of the fifth, seventh, and eighth grids to which no variable voltage is applied, respectively. Reference symbol 1H shown in FIG. 10 indicates one horizontal deflection period.

Figure 11:
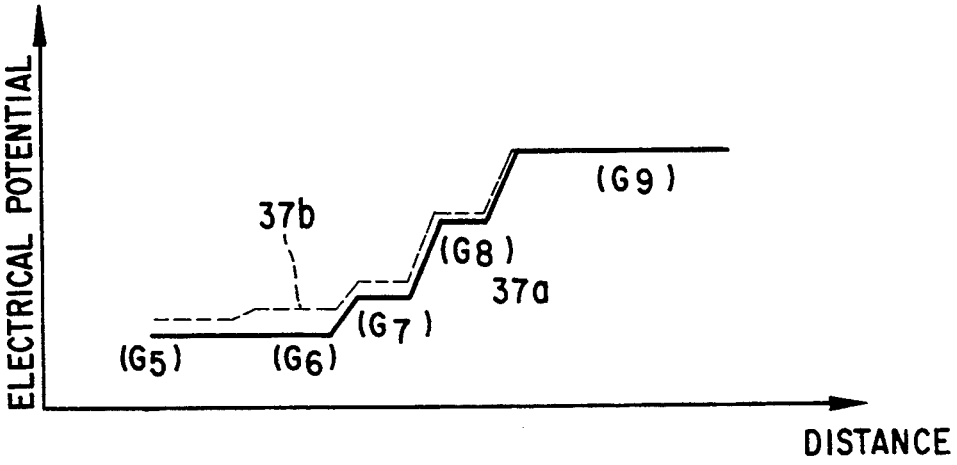
FIG. 11 is a graph showing the potentials of the fifth to ninth grids in the electron gun assembly shown in FIG. 7.
Figure 12:
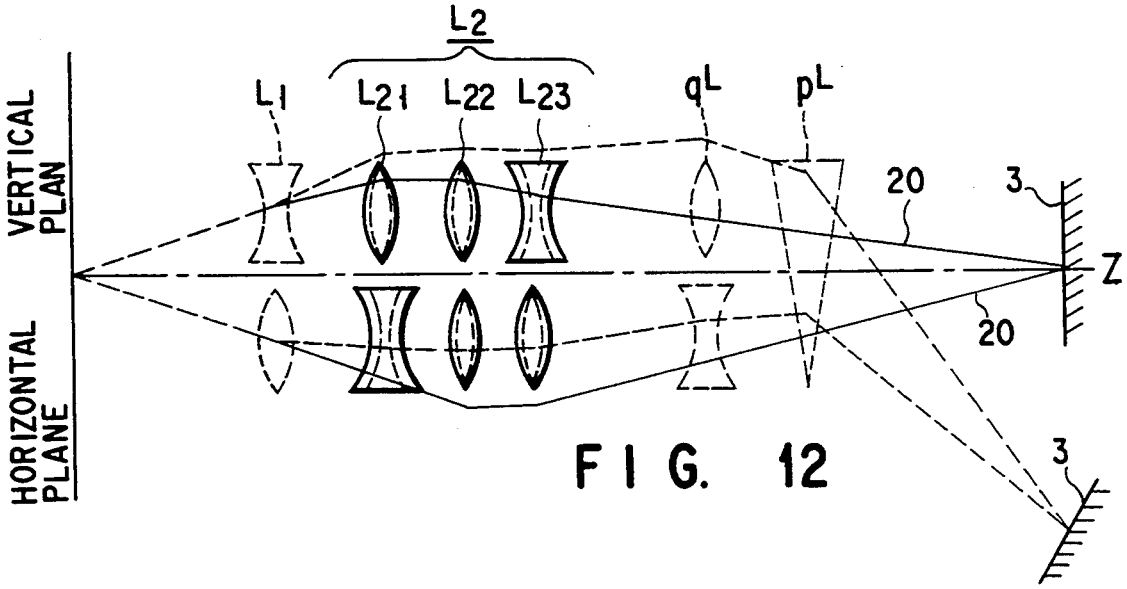
FIG. 12 is a view for explaining electron lenses formed between the electrodes of the fifth to ninth grids in the electron gun assembly shown in FIG. 7.

Curves indicating the voltages applied to the fifth to ninth grids are shown in FIG. 11, and electron lenses formed between the electrodes in accordance with the voltages applied to the fifth to ninth grids are shown in FIG. 12 using an optical model. The voltage curve indicated by a solid line 37*a* in FIG. 11 corresponds to a voltage obtained when an electron beam is directed to the center of the phosphor screen without being deflected, and a curve indicated by a broken line 37*b* corresponds to a voltage obtained when the electron beam is deflected. FIG. 12 shows the trace of an electron beam 20 on a vertical plane including a direction perpendicular to the area of the upper portion with respect to a tube axis Z in this drawing, an electron lens formed on this vertical plane, the trace of an electron beam 20 in a horizontal plane including a direction parallel to the area of the lower portion with respect to the tube axis Z and an electron lens formed on the horizontal plane. In FIG. 12, solid lines indicate the trace of the electron beam 20 which is directed to the center of the phosphor screen 3 without being deflected and the electron lenses formed at this time, and dotted lines indicate the trace of the electron beam 20 which is deflected and the electron lens formed at this time.

As shown in FIGS. 11 and 12 when the electron beam 20 is directed to the center of the phosphor screen 3 without being deflected, a voltage ec6 of the sixth grid is equal to the focusing voltage Vf and represented by equation (10). On the other hand, the voltage ec5 of the fifth grid is obtained by superposing a variable voltage induced through the capacitance between the fifth and sixth grids on the voltage Ec5 obtained by division performed by the resistor, and the voltage ec5 is represented by equation (11). The voltage ec5 of the fifth grid becomes almost equal to the voltage ec6 which is equal to the focusing Vf, and no potential difference occurs between the fifth and sixth grids. For this reason, in this case, an electron lens L1 (first electron lens) is not formed between the fifth and sixth grids.

$$ec6 = Vf \tag{10}$$

$$ec5 \approx Ec5 - (\tfrac{1}{4})Vd \tag{11}$$

In addition, an extending electron lens L2 (second electron lens) having a potential distribution continuously changes on the axis is formed between the sixth and ninth grids. This extending electron lens L2 is constituted by an electron lens L21 (quadrupole lens) formed between the sixth and seventh grids, an electron lens L22 (cylindrical lens) formed between the seventh and eighth grids, and an electron lens L23 (quadrupole lens) formed between the eighth and ninth grids. That is, with respect to the voltage ec6 represented by equation (10), the voltage ec7 of the seventh grid is obtained by superposing a variable voltage induced through the capacitance between the sixth and seventh grids on the voltage Ec7 obtained by division performed by the resistor, and the voltage ec7 is represented by equation (12). In addition, since the electron beam through holes shown in FIGS. 8A and 8C are formed in the sixth and seventh grids, respectively, an electron lens L21 constituted by a quadrupole lens having a horizontal diverging effect and a vertical focusing effect is formed between the sixth and seventh grids.

$$ec7 \approx Ec7 - (\tfrac{1}{3})Vd \tag{12}$$

In addition, with respect to the voltage ec7 of the seventh grid described above, the voltage ec8 of the eighth grid is obtained by superposing a variable voltage induced through the capacitance between the seventh and eighth grids on the voltage Ec8 obtained by division performed by the resistor, and the voltage ec8 is represented by equation (13). Since the electron beam through holes shown in FIG. 8C are formed in the seventh and eighth grids, the electron lens L22 constituted by a cylindrical lens having horizontal and vertical focusing effects is formed between the seventh and eighth grids.

$$ec8 \approx Ec8 - (1/6)\,Vd \tag{13}$$

Moreover, with respect to the voltage ec8 of the eighth grid described above, the anode voltage Eb is applied to the ninth grid, and the electron beam through holes shown in FIGS. 8C and 8D are formed in the eighth and ninth grids. For this reason, the electron lens L23 constituted by a quadrupole lens having a horizontal focusing effect and a vertical diverging effect is formed between the sixth and ninth grids.

More specifically, the extending electron lens L2 constituted by the three electron lenses L21 to L23 including a double quadrupole lens, i.e., two quadrupole lenses respectively having reverse lens effects, is formed between the sixth and ninth grids. When the electron beam 20 is directed to the center of the phosphor screen 3 without being deflected, the electron beam 20 is appropriately focused on the center of the phosphor screen 3 by the extending electron lens L2 in both the horizontal and vertical directions.

In contrast to this, when the electron beam 20 is to be deflected, an electron lens qL constituted by a quadrupole lens and a prism pL are equivalently formed between the electron gun assembly and the phosphor screen 3. In accordance with this, the variable voltage Vd increases, and the voltage ec6 of the sixth grid is obtained by superposing the variable voltage Vd on the focusing voltage Vf, and represented by equation (13).

$$ec6 = Vf + Vd \tag{13}$$

The voltage ec5 of the fifth grid is set to be a voltage represented by equation (15) using a variable voltage induced through the capacitance between the fifth and sixth grids, the voltage ec7 of the seventh grid is set to be a voltage represented by equation (16) using a variable voltage induced through the capacitance between the sixth and seventh grids, and the voltage ec8 of the eighth grid is set to be a voltage represented by equation (17) using a variable voltage induced through the capacitance between the seventh and eighth grids.

$$ec5 \approx Ec5 + (\tfrac{1}{4})Vd \tag{15}$$

$$ec7 \approx Ec7 + (\tfrac{1}{3})Vd \tag{16}$$

$$ec8 \approx Ec8 + (\tfrac{1}{4})Vd \tag{17}$$

As a result, a potential difference occurs between the fifth and sixth grids, and the electron beam through holes shown in FIGS. 8A and 8C are formed between the fifth and sixth grids. For this reason, the electron lens L1 constituted by a quadrupole lens and having a horizontal focusing effect and a vertical diverging effect is formed between the fifth and sixth grids as indicated by the broken lines.

In contrast to this, the potential difference between the sixth and seventh grids decreases, as indicated by the broken line, the effect of the electron lens L21 constituted by the quadrupole lens and formed between these electrodes is weaker than that obtained when the electron beam 20 is not deflected (indicated by the solid line), and the electron beam 20 is relatively horizontally focused and the relatively vertically diverged. In addition, the potential difference between the seventh and eighth grids decreases, the effect of the electron lens L22 constituted by the cylindrical lens and formed between these electrodes is weaker than that obtained when the electron beam 20 is not deflected, and the electron beam 20 is relatively horizontally and vertically diverged. The potential difference between the eighth and ninth grids slightly decreases, the effect of the electron lens L23 constituted by the quadrupole lens and formed between these electrodes is weaker than that obtained when the electron beam 20 is not deflected, and the electron beam 20 is relatively horizontally, slightly diverged and relatively vertically focused.

Therefore, in the extending electron lens L2 formed between the sixth and ninth grids, the relative focusing effect of the electron lens L21 and the relative diverging effects of the electron lenses L22 and L23 cancel out in the horizontal direct by changing the three electron lenses L21, L22, and L23, and a focusing state which is almost the same as that obtained when the electron beam 20 is not deflected is kept in the entire second electron lens L2. In addition, in the vertical direction, the relative diverging effects of the electron lenses L21 and L22 are larger than the relative focusing effect of the electron lens L23, and the electron beam 20 is diverged in the entire second electron lens L2.

As a result, when the electron beam 20 is to be deflected, the horizontal focusing and vertical diverging effects of the first electron lens L1 and the horizontal focusing and vertical diverging effects of the second electron lens L2 are used, and the electron beam 20 is horizontally focused by the focusing effect of the first electron lens L1, is focused by the focusing effect of the second electron lens L2, and enters into a deflection magnetic field. At this time, although the electron beam 20 receives a diverging effect by the equivalent quadrupole lens qL of the deflection magnetic field, the size of the electron beam 20 which passes through the deflection magnetic field is small because the size of the electron beam 20 is horizontally decreased by the focusing effect of the first electron lens L1. For this reason, an influence caused by the diverging effect of the deflection magnetic field is small. On the other hand, in the vertical direction, the electron beam 20 is diverged by the diverging effect of the first electron lens L1 and diverged by the diverging effect of the second electron lens L2, thereby correcting the focusing effect of the equivalent quadrupole lens qL of the deflection magnetic field. As a result, even when the electron beam 20 is to be deflected, the electron beam 20 can be appropriately focused on the phosphor screen 3 in both the horizontal and vertical directions.

The above embodiment has described a case wherein the capacitance (C) between the electrodes and an AC impedance (z) of the capacitor C are considerably smaller than a DC resistance (R), and the resistor R can be neglected. When the resistor R cannot be neglected, a phase difference occurs between the variable voltage and the DC voltage which are superposed at the fifth grid, thereby posing a problem.

That is, when the variable voltage Vd applied to the sixth grid is changed in synchronism with both the horizontal deflection and the vertical deflection of a deflection unit, the focusing states of the electron beams at the upper, lower, left, and right portions of the screen are different from each other, and image quality is not uniformed.

In order to solve the above problem, the phase difference in the variable voltage must be suppressed to a practical degree, or the voltage to be superposed on the DC voltage must be set not to make the image quality nonuniform. The relationship between the capacitance (C) between the electrodes and the resistance (R) between the electrodes, which relationship satisfies the above conditions, will be described below.

Figure 13:
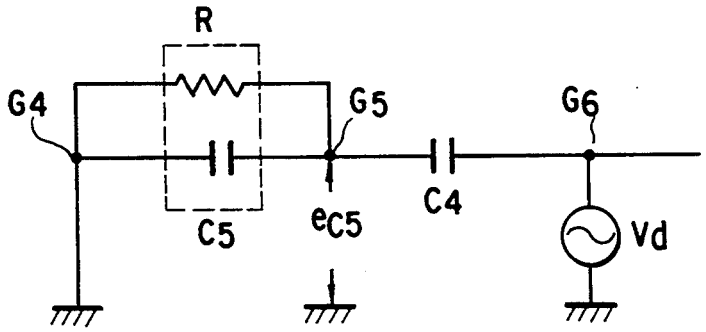
FIG. 13 is an equivalent circuit diagram for explaining a variable voltage induced through a capacitance between the electrodes of the fifth to ninth grids when an electron beam is vertically deflected in the electron gun assembly shown in FIG. 7.

The equivalent circuit near the fifth and sixth grids, as shown in FIG. 13, is obtained as follows. That is, a capacitor C5 between the fourth and fifth grids and a resistor R are parallelly arranged, and a capacitor C4 between the fifth and sixth grids is connected in series with the parallel circuit.

Therefore, in this case, the voltage ec5 superposed on a DC voltage at the fifth grid is represented by equation (18):

$$ec5 = \frac{1}{(1 + C5/C4) - j\frac{1}{\omega C4R}} Vd \quad (18)$$

where Vd is a variable voltage applied to the sixth grid, and j and $\omega$ are given by:

$$J = -1$$

$$\omega = 2\pi f \ (\pi\text{: circle ratio})$$

and f is the frequency of the variable voltage. In this case, if the following equation is established:

$$C = C4 = C5$$

the amplitude |ec5| and phase difference $\phi$ of the voltage ec5 of the fifth grid are given by equations (19) and (20):

$$|ec5| = \frac{1}{2^2 + \left(\frac{1}{\omega CR}\right)^2} \sqrt{2^2 + \left(\frac{1}{\omega CR}\right)^2} \quad (19)$$

$$\phi = \tan^{-1}\left(\frac{1}{2\omega CR}\right) \quad (20)$$

In this case, in a conventional picture tube apparatus, an electron beam performs deflection scanning in a range larger than the screen. The percentage of the range with respect to the screen is about 104 to to 110%. For this reason, an allowable phase difference $\phi$L is given by:

$$\begin{aligned} \phi L &= 2\pi \cdot (4/104) \cdot (1/2) \\ &= 4\pi/104 \end{aligned}$$

Therefore, the relationship between R and C for obtaining the practically allowable phase difference $\phi$L or less is given by:

$$1/(2 \cdot 2\pi fCr) \leqq 4\pi/104$$

$$1/(2\pi fCR) \leqq 8\pi/104$$

$$2\pi fCR \geqq 104/8\pi$$

On the other hand, the capacitance (C) is almost determined by an electrode interval and the area of opposing electrodes. Although the interval is preferably set to be large in consideration of a breakdown voltage, when the interval is set to be excessively large, charges accumulated in the neck are penetrated between the electrodes, and a problem such as degradation of the characteristics of an electron lens is posed. Therefore, the electrode interval is practically set to be about 0.4 to 1 mm. The capacitance (C) between the electrodes is set to be 1 to 4 pF. The frequency f of the variable voltage Vd changes depending on the system of a picture tube. When the NTSC scheme is used, the horizontal deflection frequency fH is 15.75 kHz, and the vertical deflection frequency fH is 60 Hz. Therefore, AC impedances ZH and ZV corresponding to the horizontal and vertical deflection frequencies fH and fV are represented by the following equations:

$$ZH = 1/(2\pi fHC)$$

$$= 2.5 \text{ to } 10\ M\Omega$$

$$ZV = 1/(2\pi fVC)$$

$$= 660 \text{ to } 2700M\ \Omega$$

In this case, in order to allow the phase difference between the variable voltage and the DC voltage which are superposed in synchronism with the horizontal deflection frequency fH, when the NTSC scheme is used, equation (21) must be established.

$$R \geqq 10 \cdot 104/8\pi M\Omega 24 \approx 40M\Omega \quad (21)$$

When R=40 MΩ, the following condition is satisfied:

$$\{1/(2\pi fHCR)\}^2 << 2^2$$

For this reason, the voltage of the fifth grid (|ec5|H) is represented by equation (22):

$$|ec5|H = 0.5Vd \quad (22)$$

about 50% of the variable voltage Vd can be superposed on the DC voltage.

On the other hand, when the resistance (R) between the electrodes is set to be 40 MΩ, the following equation is established:

$$1/(2\pi fVCR) = 32 \text{ to } 66$$

Therefore, a phase difference $\phi$V of a variable voltage superposed on the DC voltage in synchronism with the horizontal deflection frequency fH is given by:

$$\phi V = 1.50 \text{ to } 1.56\ rad$$

$$= 86° \text{ to } 89°$$

so that the phase difference poses a problem. In this case, $$\{1/(2\pi fHCR)\}^2 \leqq \leqq 2^2$$

Since this condition is satisfied, the voltage |ec5|V of the fifth grid is represented by equation (23):

$$|ec5|V \approx 2\pi fVCRVd$$

$$= 0.01Vd \text{ to } 0.06Vd \quad (23)$$

For this reason, 6% or less of the variable voltage Vd is superposed on the DC voltage at the fifth grid G5. In this case, since a voltage applied to the sixth grid in synchronism with the vertical deflection frequency fV is a voltage of about 300 V, even when about 6% of the voltage Vd is phase-shifted and superposed on the DC voltage at the grid G5 as described above, the focusing state of the electron beam does not substantially change, and the voltage can be neglected.

When evaluation was performed by an experiment, the negligible magnitude of the voltage superposed on the DC voltage with a phase shift was about 25% of the variable voltage Vd. Therefore, the relationship between the capacitance (C) and the resistance (R) which satisfies this condition is given by:

$$2\pi fVCR \leqq \tfrac{1}{4}$$

When the NTSC scheme is used, the resistance satisfies the following condition:

$$R \leqq 165 M\Omega$$

In this case, when the resistance (R) satisfies this condition, a voltage which is obtained by dividing a cathode voltage and which is applied to the grid G5 is determined. A divided voltage is 20 to 30% of an anode voltage. When the total resistance of the resistor is represented by RT, the following condition is satisfied:

$$R/RT = 0.2 \text{ to } 0.3$$

For this reason, when R = 165 MΩ, the total resistance RT is given by:

$$RT = 550 \text{ to } 825 M\Omega$$

When the total resistance RT is decreased, the power consumption of the resistor increases, and the following problems are posed. That is, the resistor is broken by heat generation, or the resistance changes with time so as to change a division ratio. Therefore, the reliability of the resistor is degraded, and the performance of the cathode ray tube itself is degraded. Therefore, the resistance cannot be set to be a very small value, and the total resistance RT is generally set to be 800 MΩ or more to set the power consumption of the resistor to be 2 W or less. Therefore, the resistance R satisfies the following condition:

$$R \geqq 160\ M\Omega$$

Therefore, the capacitance (C) satisfies the following condition:

$$2\pi fVC \cdot 160 \times 10^6 \leqq \tfrac{1}{4}$$

$$C \leqq 4pF$$

Since the capacitance between the electrodes depends on an interval: L therebetween and an area: S of the opposite portion between the electrodes, in order to satisfy C≦4 pF, the following equation must be established:

$$C = 1 \cdot \epsilon 0/S \leqq 4 \times 10^{-6}$$

Therefore, the interval L and the area S need satisfy only the following condition:

$$S/L \leqq 0.45$$

When the opposing electrodes have different areas, the area of the overlapping surface between the electrodes may be used as the area S.

When the relationship between the resistance (R) and the capacitance (C) is set as described above, and the voltage Vd is applied to the sixth grid in synchronism with a horizontal deflection frequency between ten kHz and twenty kHz or more, about 50% of the voltage Vd can be superposed on a DC voltage at the fifth grid with a phase difference falling within a practical range, and the aberration of a deflection magnetic field can be corrected by changing the focusing state of an electron beam as described above. In addition, when the voltage Vd is applied to the sixth grid in synchronism with a vertical deflection frequency of several tens to several hundreds Hz, a variable voltage which is phase-shifted from the DC voltage by about 90° is superposed on the DC voltage at the fifth grid. At this time, the superposed voltage can be set to be 25% or less of the voltage Vd, and the superposed voltage does not substantially influence the focusing state of the electron beam. A potential difference occurs as the voltages Vd between the fifth and sixth grids, the first electron lens L1 between the fifth and sixth grids shown in FIG. 12 strongly works, and this first electron lens L1 works together with the second electron lens L2. As a result, vertical over-focus of the electron beam caused by the deflection error of a vertical deflection magnetic field can be corrected by the voltage Vd which is set to be very low.

More specifically, when the variable voltage superposed on the DC voltage at the sixth grid is changed in synchronism with both the horizontal deflection and the vertical deflection, the variable voltage synchronized with the horizontal deflection causes the first electron lens L1 between the fifth and sixth grids and the second electron lens L2 between the sixth and ninth grids to work in the same manner as described above in which the resistance (R) is neglected. However, when the variable voltage synchronized with the vertical deflection is applied, the following automatic selecting effect using a deflection frequency can be obtained. That is, although the second electron lens works in the same manner as that performed when the variable voltage synchronized with the horizontal deflection is applied, the first electron lens works stronger than that which works when the variable voltage synchronized with the horizontal deflection is applied. For this reason, especially, beam distortion at the corners of a screen can be corrected by a low dynamic voltage.

In each of the above embodiments, an electron gun assembly having extending field effect electron lenses including a quadrupole lens has been described. However, the present invention can also be applied to an electron gun assembly in which a quadrupole lens is combined with another electron lens and the quadrupole lens section is used as a first electron lens, e.g., an electron gun assembly having the quadrupole lens and a BPF (Bi-Potential Focus) type electron lens.

As has been described above, in a color cathode ray tube apparatus comprising an electron gun assembly having a main electron lens section constituted by a plurality of electrodes for focusing three electron beams which are arranged in a line and obtained from an electron beam generating section on a target and a deflection unit for deflecting the three electron beams emitted from the electron gun assembly in horizontal and vertical directions, the main electron lens section is constituted by at least a first electron lens and a second electron lens formed between the first electron lens and a phosphor screen, and the first electron lens is constituted by a first electrode to which a voltage changed in synchronism with at least the horizontal deflection amount of the electron beams in the deflection unit is applied from the outside of the tube and at least one second electrode to which a voltage is applied through an electric resistor. The variable voltage is divided by a capacitance between the first electrode and the second electrode, and the divided voltages are superposed on the voltage of the second electrode. When the electron beams are directed to the center of the phosphor screen, the voltages of the first and second electrodes are almost equal to each other. When the electron beams are deflected to the peripheral portion of the phosphor screen, a difference between the voltages of the first and second electrodes occurs.

In a detailed arrangement of the present invention, for example, a capacitance (C) between the first and second electrodes, a DC resistance (R) equivalently, parallelly connected to the capacitance, and a frequency (fH) synchronized with the horizontal deflection of a variable voltage satisfy the following relation:

$$2\pi fHCR \geqq 104/8\pi \text{ (}\pi\text{:circle ratio)}$$

In addition, the capacitance (C), the resistance (R), and a frequency (fV) synchronized with the vertical deflection of the variable voltage preferably satisfy the following relationship:

$$2\pi fVCR \geqq \tfrac{1}{4}$$

As a result, the variable voltage can be superposed on the DC voltage at the second electrode through the capacitance between the first and second electrodes without a substantial phase difference, and an electron lens which changes the focusing states of the electron beams of the main electron lens section in synchronization with the deflection of the electron beams can be obtained.

When the first and second electron lenses are constituted by quadrupole lenses for horizontally focusing the electron beams and vertically diverging them in accordance with the deflection of the electron beams, vertical over-focus caused by a deflection error can be corrected. In particular, the electron beam can be horizontally focused by the first electron lens, and the size of the electron beam passing through a deflection magnetic field can be decreased. For this reason, the horizontal size of the beam spot on the screen can be decreased. In addition, when the variable voltage is synchronized with both the horizontal deflection and the vertical deflection, a frequency selecting effect in which the first electron lens has a lens effect to the vertical deflection which is relatively stronger than that to the horizontal deflection can be obtained. For this reason, beam distortion at the corner portions of the screen can be corrected by a low variable voltage.

In addition, when voltages obtained by dividing an anode voltage by a resistor arranged in the tube are applied, and only another voltage obtained by superposing a variable voltage on a focusing voltage for adjusting the focusing states of the electron beams is applied from the outside of the tube, a high-performance cathode ray tube which has high reliability such as a high breakdown voltage and can obtain a high resolution in the entire area of the screen can be obtained.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A color cathode ray tube apparatus, comprising:

an electron gun assembly including a generating section for generating three electron beams arranged in a line, first and second electrodes which oppose each other and through which the three electron beams pass, a capacitance being formed between said first and second electrodes;

deflecting means for horizontally and vertically deflecting the three electron beams emitted from said electron gun assembly;

a target on which the deflected electron beams are landed and which generates light rays in response to landing;

an electric resistor arranged along said first and second electrodes and connected to said first electrode;

first applying means for applying a first voltage to said second electrode, the first voltage being obtained by superposing a first variable voltage changed in accordance with a deflection amount of the electron beams deflected by said deflecting means on a predetermined first DC voltage; and second applying means for applying a second DC voltage to said first electrode through said resistor, said second applying means substantially applying a second voltage which corresponds to the first variable voltage induced from said second electrode through the capacitance between said first and second electrodes on the second DC voltage and is obtained by superposing a second variable voltage on the second DC voltage, wherein electron lens means for focusing the electron beams on said target is formed by said first and second electrodes, and a focusing lens power of said electron lens is changed in accordance with changes in the first and second variable voltages synchronized with deflection of the electron beams, thereby changing focusing states of the electron beams, said lens means constituted by at least a first electron lens and a second electron lens formed closer to said phosphor screen than said first electron lens, a lens power of said first electron lens is changed in synchronism with at least a horizontal deflection amount of the electron beams, and said first and second electrodes have almost equal voltages when the electron beams is directed to a center of said phosphor screen, and when the electron beams are deflected to a peripheral portion of said phosphor screen, a difference between the voltages of said first and second electrodes occurs to cause said second electron lens to work.

2. An apparatus according to claim 1, wherein a capacitance C between said first and second electrodes, a DC resistance R equivalently, parallelly connected to the capacitance, and a frequency fH synchronized with horizontal deflection of the variable voltage satisfy the following relationship:

$$2\pi fHCR \geqq 104/8\pi \text{ (}\pi\text{:circle ratio)}$$

and the capacitance C, the resistance R, and a frequency fV synchronized with vertical deflection of the variable voltage satisfy the following relationship:

$2\pi fVCR \geqq \frac{1}{4}$

3. An apparatus according to claim 2, wherein said first electron lens focuses the three electron beams in a horizontal direction and diverges the three electron beams in a vertical direction in accordance with deflection of the electron beams.

4. An apparatus according to claim 2, wherein an area S of a substantially opposing surface between said first and second electrodes and an interval L between said first and second electrodes satisfy the following relationship:

$S/L \leqq 0.45.$

* * * * *

UNITED STATES PATENT AND TRADEMARK OFFICE

CERTIFICATE OF CORRECTION

PATENT NO. : 5,449,983

DATED : Sep. 12, 1995

INVENTOR(S) : Sugawara et al.

It is certified that error appears in the above-identified patent and that said Letters Patent is hereby corrected as shown below:

Please substitute the attached FIGURE 10 for the one printed on Sheet 4 of the above-identified patent.

Signed and Sealed this

Eleventh Day of April, 2000

*Attest:*

*Attesting Officer*

Q. TODD DICKINSON

*Director of Patents and Trademarks*

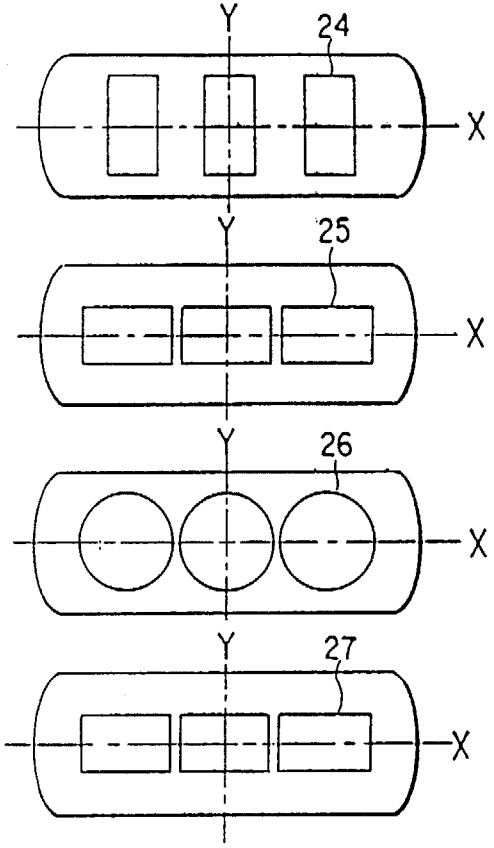
FIG. 8A
FIG. 8B
FIG. 8C
FIG. 8D
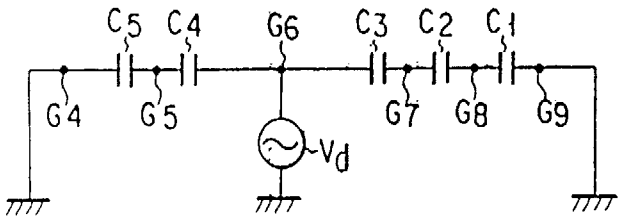
FIG. 9
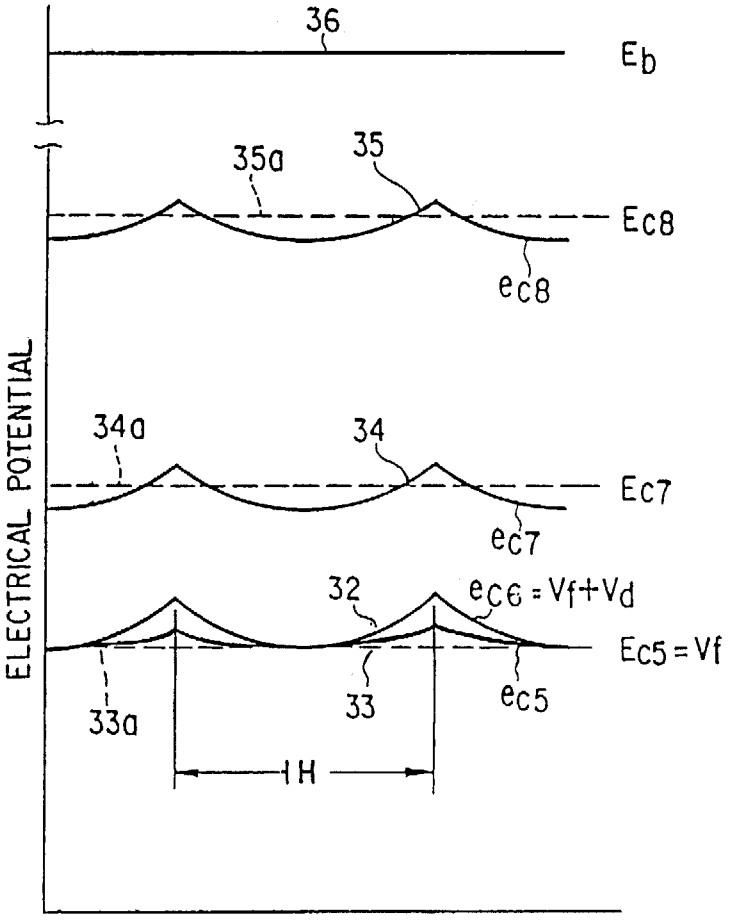
FIG. 10